US009605571B2

(12) United States Patent
Ishikawa

(10) Patent No.: US 9,605,571 B2
(45) Date of Patent: Mar. 28, 2017

(54) GENERAL-PURPOSE ENGINE

(71) Applicant: HONDA MOTOR CO., LTD., Tokyo (JP)

(72) Inventor: Takeshi Ishikawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 187 days.

(21) Appl. No.: 14/644,630

(22) Filed: Mar. 11, 2015

(65) Prior Publication Data

US 2015/0267578 A1 Sep. 24, 2015

(30) Foreign Application Priority Data

Mar. 24, 2014 (JP) ..... 2014-060391

(51) Int. Cl.

| | |
|---|---|
| ***F02B 75/00*** | (2006.01) |
| ***F01M 1/04*** | (2006.01) |
| ***F01M 9/10*** | (2006.01) |
| ***F01M 11/02*** | (2006.01) |
| ***F01M 9/06*** | (2006.01) |
| ***F01M 11/00*** | (2006.01) |
| ***F01M 11/06*** | (2006.01) |
| ***F01M 9/12*** | (2006.01) |

(52) U.S. Cl.

CPC ..... *F01M 11/02* (2013.01); *F01M 1/04* (2013.01); *F01M 9/06* (2013.01); *F01M 9/105* (2013.01); *F01M 9/12* (2013.01); *F01M 11/0004* (2013.01); *F01M 11/062* (2013.01); *F01M 2011/0033* (2013.01); *F01M 2011/021* (2013.01)

(58) Field of Classification Search

CPC ..... F01M 11/02; F01M 9/06; F01M 9/105; F01M 11/0004; F01M 11/062; F01M 2011/0033; F01M 2011/021

USPC ..... 123/196 R, 72, 195 AC, 196 CP

See application file for complete search history.

(56) References Cited

FOREIGN PATENT DOCUMENTS

| | | |
|---|---|---|
| DE | 197 38 155 A1 | 3/1998 |
| EP | 2 123 867 A1 | 11/2009 |
| JP | 58-146016 U | 10/1983 |
| JP | 60-18210 U | 2/1985 |
| JP | 62-15451 U | 1/1987 |
| JP | 62-225711 A | 10/1987 |

OTHER PUBLICATIONS

European Search Report dated May 13, 2015, issued in corresponding European Patent Application No. 15 16 0479 (2 pages).

*Primary Examiner* — Lindsay Low
*Assistant Examiner* — Syed O Hasan
(74) *Attorney, Agent, or Firm* — Westerman, Hattori, Daniels & Adrian, LLP

(57) ABSTRACT

In a general-purpose engine including a cylinder block extending obliquely from one side of a crank case, and a cylinder head connected to an end surface of the cylinder block via a gasket, a unidirectional valve for allowing a flow of a fluid from a crank chamber to a valve operating chamber and blocking a reverse flow of the fluid is installed in an upper oil passage. In a case where lubricant oil reserved in the crank chamber flows into the valve operating chamber via a lower oil passage when the engine inclines such that the inclined cylinder block further slants, positive pressures transmitted from the crank chamber to the valve operating chamber push the oil, which once flows into the valve operating chamber, back to the crank chamber via the lower oil passage.

5 Claims, 4 Drawing Sheets

GENERAL-PURPOSE ENGINE

BACKGROUND OF THE INVENTION

Field of the Invention

The present invention relates to an improvement of a general-purpose engine used for power of various work machines such as a lawn mower and the like, particularly, a general-purpose engine comprising: a crank case having a mounting flange in a bottom portion of the crank case; a cylinder block extending obliquely from one side of the crank case; and a cylinder head connected to an end surface of the cylinder block via a gasket, in which a crank chamber in the crank case includes oil spray generating means for generating oil spray for lubricating engine parts by scattering lubricant oil reserved in the crank chamber, and upper and lower side portions of the cylinder block and the cylinder head are provided respectively with an upper oil passage and a lower oil passage which communicate the crank chamber and a valve operating chamber in the cylinder head with each other.

Description of the Related Art

Such a general-purpose engine is known as disclosed in, for example, Japanese Utility Model Publication No. 62-15451.

In a general-purpose engine of this type, depending on a use condition of a work machine, an inclined cylinder block may be further inclined. In this case, it is likely that: a large amount of oil reserved in a crank chamber flows into a valve operating chamber via a lower oil passage; thereby, the amount of oil reserved in the crank chamber decreases to a large extent, and oil spray generating means insufficiently generates oil spray; and lubrication of engine parts is hindered.

SUMMARY OF THE INVENTION

The present invention has been made with the foregoing situation taken into consideration. An object of the present invention is to provide a general-purpose engine in which even though oil reserved in a crank chamber flows into a valve operating chamber via a lower oil passage when an inclined cylinder block is further inclined, the oil once flowing into the valve operating chamber is quickly pushed back to the crank chamber to secure the amount of oil reserved in the crank chamber, and to keep engine parts lubricated without hindrance.

In order to achieve the object, according to a first aspect of the present invention, there is provided a general-purpose engine comprising: a crank case having a mounting flange in a bottom portion of the crank case; a cylinder block extending obliquely from one side of the crank case; and a cylinder head connected to an end surface of the cylinder block via a gasket, in which a crank chamber in the crank case includes oil spray generating means for generating oil spray for lubricating engine parts by scattering lubricant oil reserved in the crank chamber, and upper and lower side portions of the cylinder block and the cylinder head are provided respectively with an upper oil passage and a lower oil passage which communicate the crank chamber and a valve operating chamber in the cylinder head with each other, wherein a unidirectional valve for allowing a flow of a fluid from the crank chamber to the valve operating chamber and blocking a reverse flow of the fluid is installed in the upper oil passage, and in a case where the lubricant oil reserved in the crank chamber flows into the valve operating chamber via the lower oil passage when the engine inclines such that the obliquely extending cylinder block further slants, positive pressures transmitted from the crank chamber to the valve operating chamber via the unidirectional valve push the oil, which once flows into the valve operating chamber, back to the crank chamber via the lower oil passage. Note that the oil spray generating means corresponds to an oil dipper 24 of an embodiment of the present invention, described later.

According to the first aspect, even though a large amount of oil flows from the crank chamber into the valve operating chamber via the lower oil passage when, depending on a use condition of a work machine, the engine is forced to be oriented such that the obliquely extending cylinder block is further slanted, operation of the unidirectional valve in the upper oil passage, based on operation of the engine, causes positive pressures out of pulsating pressures generated in the crank chamber to be transmitted to the valve operating chamber via the upper oil passage. For this reason, pressure inside the valve operating chamber becomes higher, and the oil once flowing into the valve operating chamber can be pushed back to the crank chamber via the lower oil passage. This prevents a decrease in the amount of oil reserved in the crank chamber, and enables the oil spray generating means to always generate the oil spray, accordingly making it possible to keep the engine parts lubricated satisfactorily.

According to a second aspect of the present invention, in addition to the first aspect, the gasket interposed between the cylinder block and the cylinder head divides the upper oil passage into an upstream passage on the crank chamber side and a downstream passage on the valve operating chamber side, the gasket includes a valve attachment hole, and a plurality of through-holes disposed surrounding the valve attachment hole, and communicating the upstream passage and the downstream passage with each other, and the unidirectional valve includes a valve body having an elastic umbrella portion seated on an upper surface of the gasket facing the downstream passage, and covering a group of the through-holes, and a stem portion projecting from a boss portion of the elastic umbrella portion, and penetrating through the valve attachment hole, and a retaining member fitted and fixed to the stem portion, and thereby clamping the gasket in cooperation with the boss portion.

According to the second aspect, it is possible to easily attach the unidirectional valve by use of the gasket, and to use the unidirectional valve without making major alterations to a conventional engine, as well as to minimize improvement costs.

According to a third aspect of the present invention, in addition to the second aspect, the stem portion is formed smaller in diameter than the valve attachment hole such that an outer peripheral surface of the stem portion is prevented from touching an inner peripheral surface of the valve attachment hole, and the retaining member includes a plurality of positioning claws respectively engaging with the plurality of through-holes to thereby hold the stem portion at a position concentric with the valve attachment hole.

According to the third aspect, the stem portion of the valve body does not touch the inner peripheral surface of the valve attachment hole with a certain distance kept between an overall periphery of the stem portion and the inner peripheral surface of the valve attachment hole. Accordingly, the stem portion can be prevented from damage due to its contact with a sharp inner peripheral edge of the valve attachment hole in the thin gasket, and to maintain durability of the stem portion. Furthermore, since the through-holes for allowing passage of the positive pressures double as the holes with which the positioning claws engage, it is unnecessary to provide dedicated positioning holes in the gasket. This contributes to simplifying the structure.

According to a fourth aspect of the present invention, in addition to the second or third aspect, the stem portion includes a first shaft portion extending from the boss portion, and fitted into a fitting hole in the retaining member, and a second shaft portion coaxially continuing to the first shaft portion via an expanded portion, and being smaller in diameter than the first shaft portion, and the expanded portion is formed larger in diameter than the first shaft portion to hold the retaining member on the first shaft portion by engaging with a rear surface of the retaining member.

According to the fourth aspect, ease of installation of the unidirectional valve can be enhanced.

The above and other objects, characteristics and advantages of the present invention will be clear from detailed descriptions of the preferred embodiment which will be provided below while referring to the attached drawings.

DESCRIPTION OF THE PREFERRED EMBODIMENT

Descriptions will be hereinbelow provided for an embodiment of the present invention on the basis of the accompanying drawings.

Figure 1:
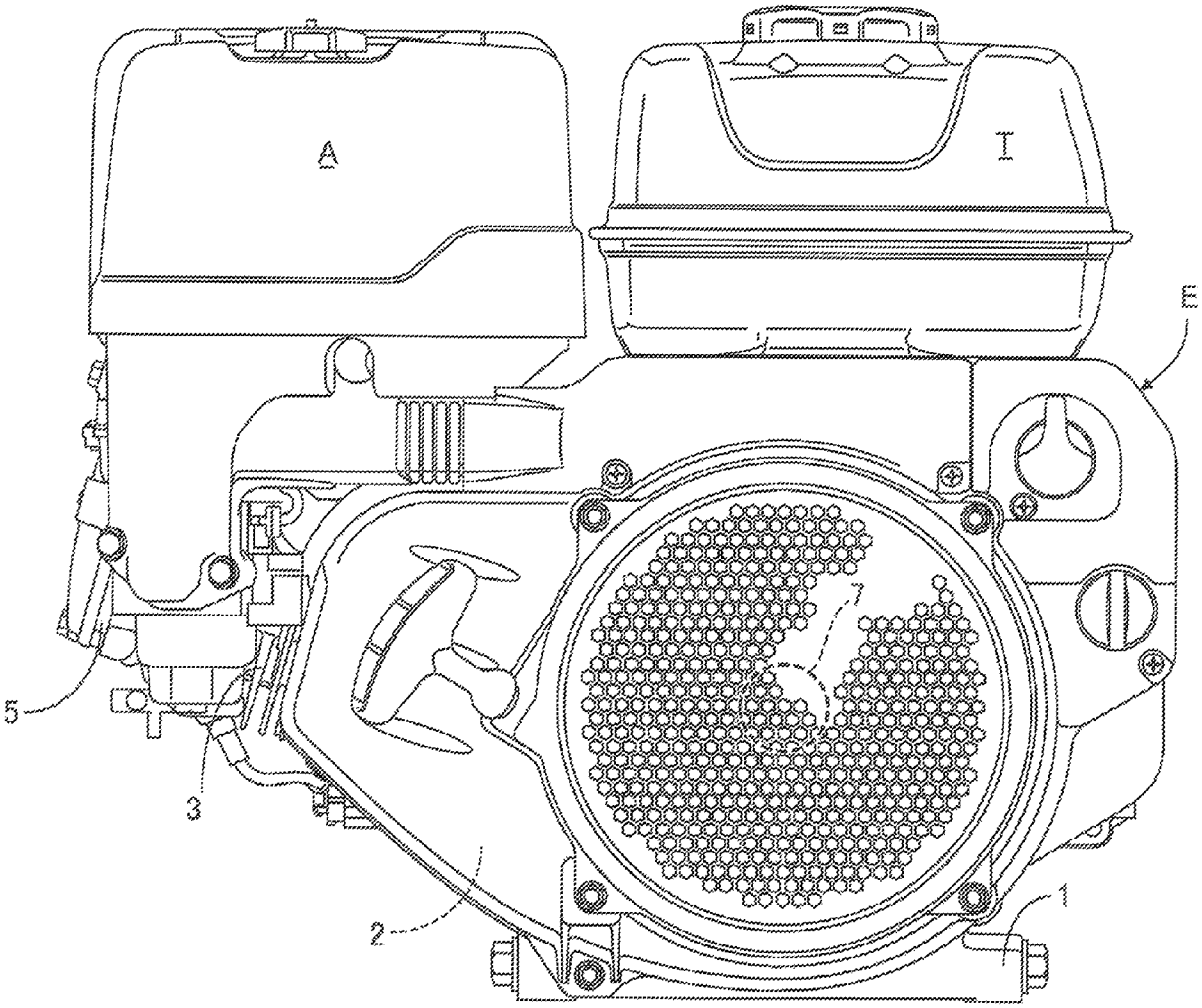
FIG. 1 is an elevation view of a general-purpose engine of an embodiment of the present invention.
Figure 2:
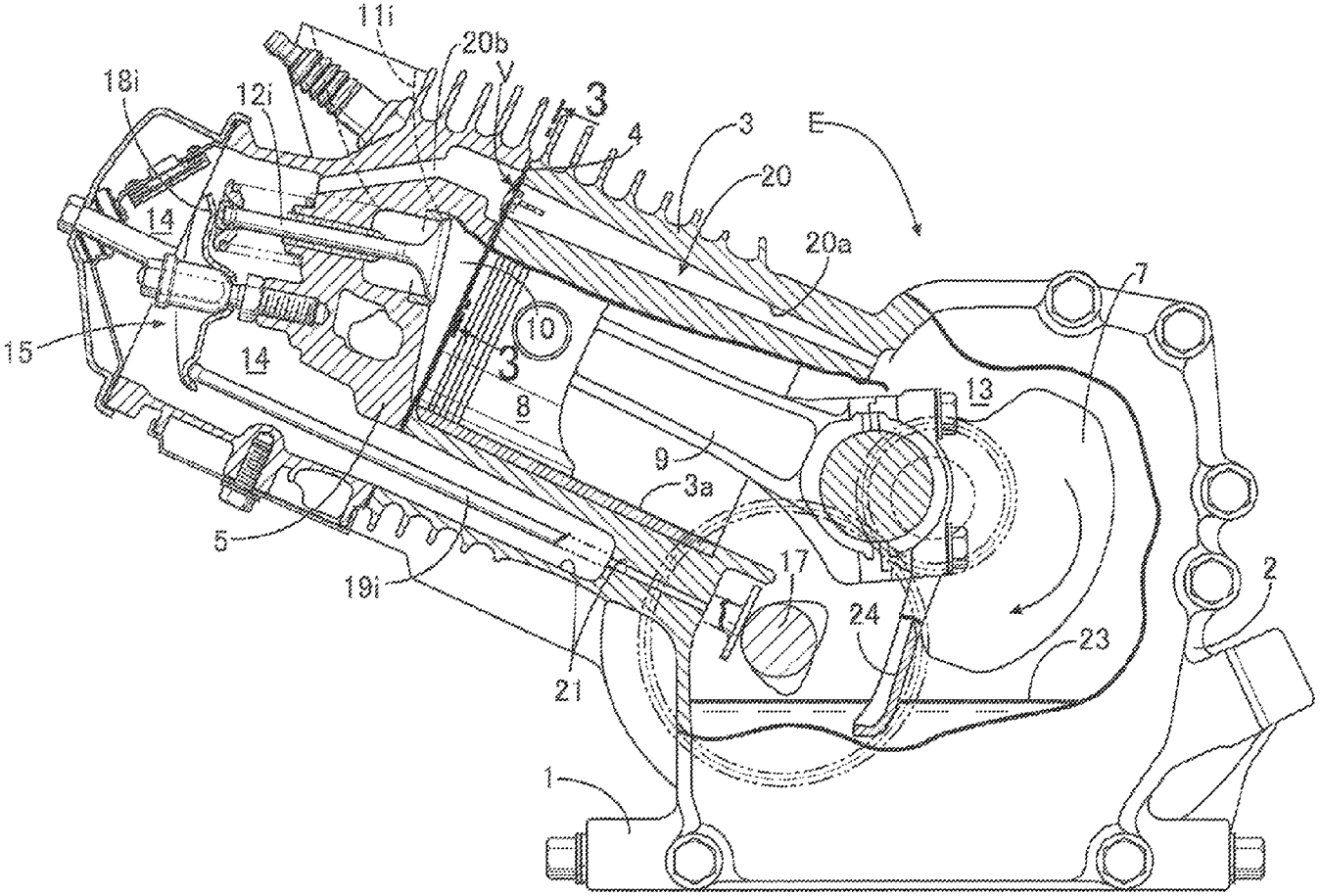
FIG. 2 is a longitudinal cross-sectional elevation view of the general-purpose engine.

In FIGS. 1 and 2, a general-purpose engine E includes: a crank case 2 having a mounting flange 1 in its bottom portion; a cylinder block 3 extending obliquely from one side of the crank case 2; and a cylinder head 5 connected to an end surface of the cylinder block 3 via a gasket 4. A fuel tank T and an air cleaner A are attached to upper portions of the crank case 2 and the cylinder block 3, respectively. The mounting flange 1 is mounted on a work machine which uses the general-purpose engine E as a driving source.

A crank shaft 7 is disposed in a crank chamber 13 inside the crank case 2. The crank shaft 7 is linked, via a connecting rod 9, to a piston 8 which is fitted in a cylinder bore 3*a* of the cylinder block 3. In addition, a combustion chamber 10 continuing to the cylinder bore 3*a*, as well as an intake port 11*i* and an exhaust port (not illustrated) both opened to the combustion chamber 10 are formed in the cylinder head 5. The cylinder head 5 is provided with: an intake valve 12*i* for opening and closing the intake port 11*i*; and an exhaust valve (not illustrated) for opening and closing the exhaust port. An intake rocker arm 18*i* of a valve operating device 15 for driving the intake valve 12*i* to open and close, and an exhaust rocker arm (not illustrated) of the valve operating device 15 for driving the exhaust valve to open and close are disposed in a valve operating chamber 14 inside the cylinder head 5. The intake rocker arm 18*i* and the exhaust rocker arm are swung by a cam shaft 17, which is disposed in the crank chamber 13 and driven at a reduced speed by the crank shaft 7, via an intake push rod 19*i* and an exhaust push rod (not illustrated), respectively. Thereby, the intake rocker arm 18*i* and the exhaust rocker arm open and close the intake valve 12*i* and the exhaust valve, respectively. The intake push rod 19*i* and the exhaust push rod are disposed extending in a lower side portion of the cylinder block 3.

In the crank chamber 13, lubricant oil 23 is reserved at a certain level which does not reach a lower oil passage 21. An oil dipper 24 for generating oil spray by scattering the oil 23 is annexed to a larger end portion of the connecting rod 9.

Furthermore, an upper oil passage 20 and the lower oil passage 21, which communicate the crank chamber 13 and the valve operating chamber 14 with each other while penetrating through the gasket 4 between the cylinder block 3 and the cylinder head 5, are provided to upper and lower side portions of the cylinder block 3 and the cylinder head 5, respectively. The lower oil passage 21 is disposed between the intake push rod 19*i* and the exhaust push rod.

A unidirectional valve V for allowing a flow of a fluid from the crank chamber 13 to the valve operating chamber 14 and blocking a reverse flow of the fluid is installed in the upper oil passage 20. The unidirectional valve V is attached to the gasket 4, as follows.

Figure 3:
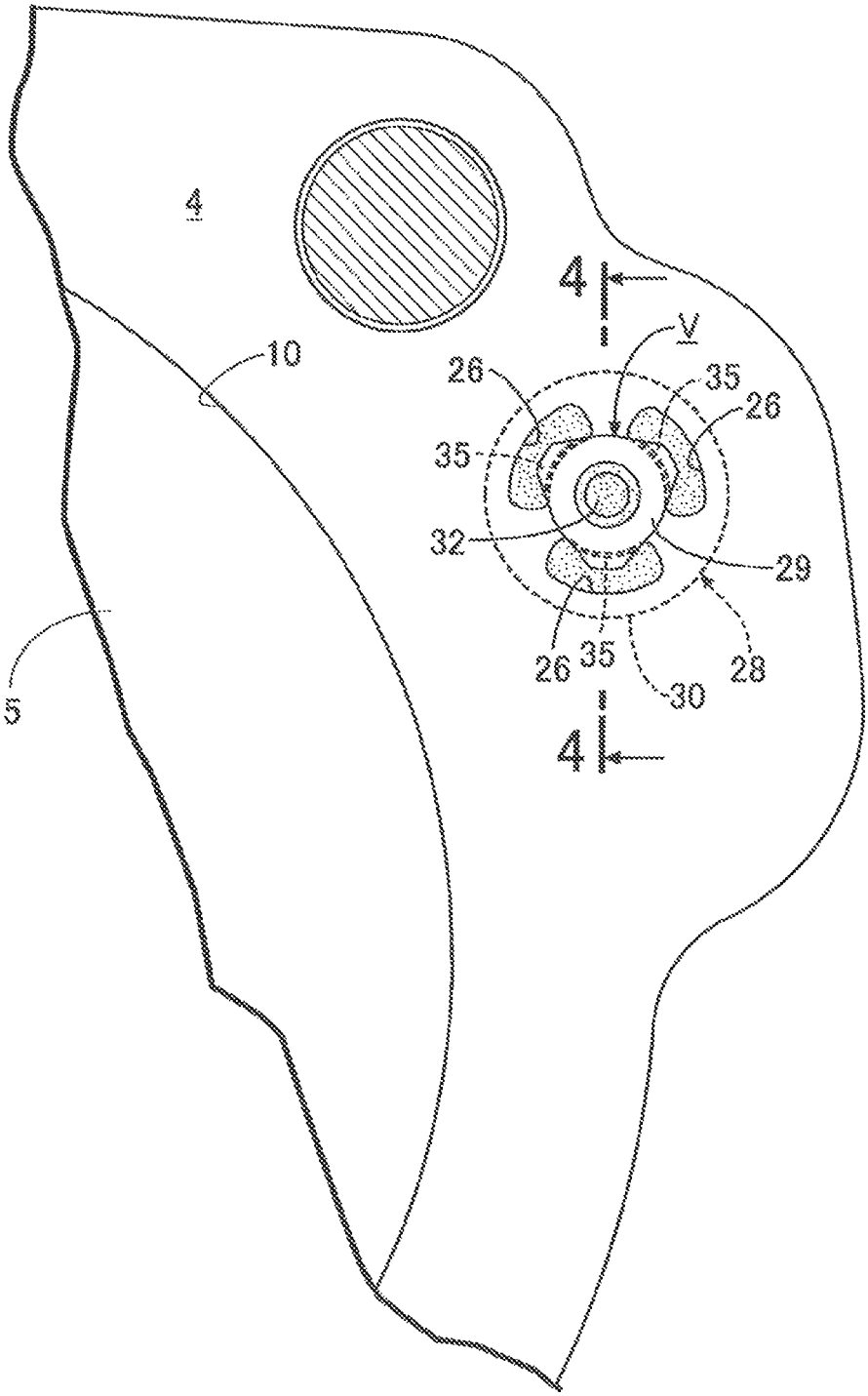
FIG. 3 is an enlarged sectional view taken along a 3-3 line of FIG. 2.
Figure 4:
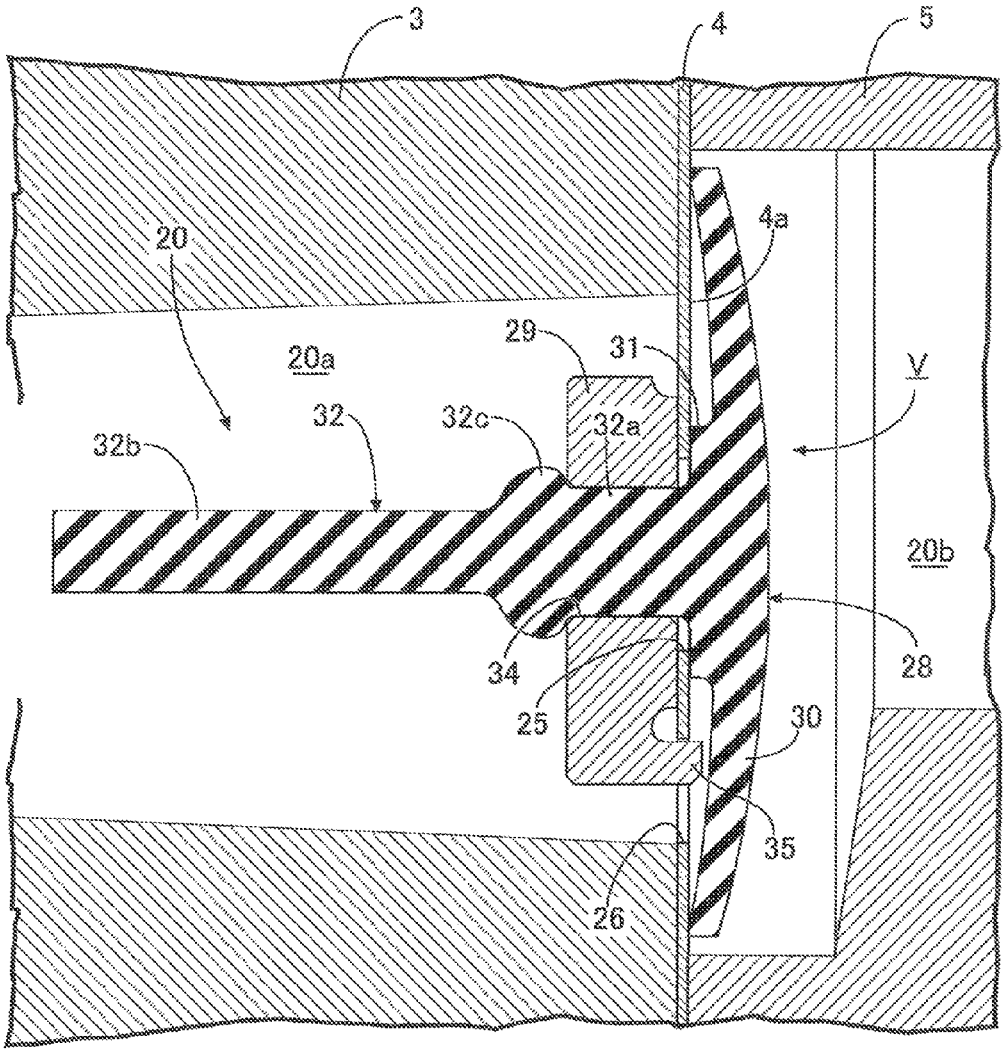
FIG. 4 is an enlarged sectional view taken along a 4-4 line of FIG. 3.

As shown in FIGS. 3 and 4, the gasket 4 divides the upper oil passage 20 into an upstream passage 20*a* on the crank chamber 13 side and a downstream passage 20*b* on the valve operating chamber 14 side. The gasket 4 is provided with: a valve attachment hole 25; and multiple (three in the illustrated example) through-holes 26 disposed surrounding the valve attachment hole 25, and communicating the upstream passage 20*a* and the downstream passage 20*b* with each other.

The unidirectional valve V includes: a valve body 28 made from an elastic material such as rubber or the like; and a retaining member 29 made from a synthetic resin. The valve body 28 includes: an elastic umbrella portion 30; a boss portion 31 formed at a center of the elastic umbrella portion 30, and projecting toward the gasket 4; and a stem portion 32 extending from the boss portion 31. Furthermore, the stem portion 32 includes: a first shaft portion 32*a* extending from the boss portion 31, and being fully smaller in diameter than the valve attachment hole 25; and a second shaft portion 32*b* coaxially continuing to the first shaft portion 32*a* via an expanded portion 32*c*, and being smaller in diameter than the first shaft portion 32*a*. The valve body 28 is disposed with the stem portion 32 inserted in the valve attachment hole 25, and with the umbrella portion 30 seated on an upper surface 4*a* of the gasket 4 facing the downstream passage 20*b*.

The retaining member 29 has a fitting hole 34 in a central portion, and further has, in an outer periphery, positioning claws 35 which are as many as the through-holes 26, and which project in an axial direction.

Connecting of the retaining member 29 to the valve body 28 is achieved by: inserting the second shaft portion 32*b* of the valve body 28 into the fitting hole 34; and thereafter pressing the retaining member 29 toward the first shaft portion 32*a* while pulling the thus-inserted second shaft portion 32*b*. Thereby, the expanded portion 32*c* stretches, and reduces its diameter. This makes it possible for the fitting hole 34 of the retaining member 29 to pass through the expanded portion 32*c*, and to become fitted to the first shaft portion 32*a*. Thereafter, once the second shaft portion 32*b* is released from the pulling, the expanded portion 32*c* returns to its original shape with a larger diameter, and engages with a rear surface of the retaining member 29. Thereby, the expanded portion 32*c* holds the retaining member 29 at a position where the retaining member 29 is fitted to the first shaft portion 32*a*. Once fitted to the first shaft portion 32*a*, the retaining member 29 clamps the gasket 4 in cooperation with the boss portion 31 of the valve body 28.

At this time, the multiple positioning claws 35 of the retaining member 29 engage with the multiple through-holes 26 in the gasket 4 to thereby hold the stem portion 32 at a position concentric with the valve attachment hole 25. Thereby, the first shaft portion 32*a*, which is fully smaller in diameter than the valve attachment hole 25, is prevented from touching an inner peripheral surface of the valve attachment hole 25, since a certain distance is kept between an overall periphery of the first shaft portion 32*a* and the inner peripheral surface of the valve attachment hole 25.

It should be noted that albeit not illustrated, a breather pipe for discharging a blowby gas into an intake system is connected to an upper portion of the valve operating chamber 14.

Next, descriptions will be provided for an operation of this the embodiment.

While the general-purpose engine E is in operation with a normal orientation in which the mounting flange 1 is set horizontally, the oil 23 reserved in the crank chamber 13 does not reach the lower oil passage 21, and the oil dipper 24 swinging in response to rotation of the crank shaft 7 is hitting and scattering the reserved oil 23, thereby generating the oil spray. Peripheries of the piston 8 and the connecting rod 9 are lubricated with the oil spray. Furthermore, the oil spray passes the upper oil passage 20 and the lower oil passage 21, and reaches the valve operating chamber 14, where the oil spray also lubricates the valve operating device 15.

Particularly since the unidirectional valve V for allowing the flow of the fluid from the crank chamber 13 to the valve operating chamber 14 and blocking the reverse flow is installed in the upper oil passage 20, only positive pressures out of pulsating pressures generated in the crank chamber 13 in response to reciprocating motion of the piston 8 can pass through the upper oil passage 20, and the positive pressures carry the oil spray to the valve operating chamber 14.

To put it concretely, when a positive pressure out of the pulsating pressures generated in the crank chamber 13 acts on the elastic umbrella portion 30 of the unidirectional valve V via the through-holes 26 in the gasket 4, the elastic umbrella portion 30 is pushed open, and allows the positive pressure to pass through the upper oil passage 20. On the other hand, when a negative pressure acts on the elastic umbrella portion 30 via the through-holes 26, the elastic umbrella portion 30 is pulled to the gasket 4, becomes seated on the upper surface 4*a*, and closes the through-holes 26, thereby blocking the negative pressure from passing through the upper oil passage 20. In this manner, only the positive pressures pass through the upper oil passage 20.

In a case where, depending on a use condition of the work machine, the general-purpose engine E is forced to be oriented such that the obliquely extending cylinder block 3 is further slanted, a large amount of oil 23 flows from the crank chamber 13 into the valve operating chamber 14 via the lower oil passage 21. However, when the general-purpose engine E is operated, operation of the unidirectional valve V, in the upper oil passage 20 as described above, causes the positive pressures out of the pulsating pressures generated in the crank chamber 13 to be transmitted to the valve operating chamber 14 via the upper oil passage 20. For this reason, pressure inside the valve operating chamber 14 becomes higher, and the oil 23 once flowing into the valve operating chamber 14 can be accordingly pushed back to the crank chamber 13 via the lower oil passage 21. This prevents a decrease in the amount of oil 23 reserved in the crank chamber 13, and enables the oil dipper 24 to always generate the oil spray, accordingly making it possible to keep the engine parts lubricated satisfactorily.

Meanwhile, the gasket 4 interposed between the cylinder block 3 and the cylinder head 5 is provided with: the valve attachment hole 25; and the multiple through-holes 26 disposed surrounding the valve attachment hole 25, and communicating with the upper oil passage 20. The unidirectional valve V includes: the valve body 28 which includes the elastic umbrella portion 30 for covering the group of the through-holes 26 while seated on the upper surface 4*a* of the gasket 4 facing the downstream passage 20*b* of the upper oil passage 20, and the stem portion 32 projecting from the boss portion 31 of the elastic umbrella portion 30, and penetrating through the valve attachment hole 25; and the retaining member 29 fitted and fixed to the stem portion 32 so as to clamp the gasket 4 in cooperation with the boss portion 31. For these reasons, it is possible to easily attach the unidirectional valve V by use of the gasket 4, and to use the unidirectional valve V without making major alterations to a conventional general-purpose engine, as well as to minimize improvement costs.

Furthermore, the stem portion 32 of the valve body 28 is formed smaller in diameter than the valve attachment hole 25 such that the outer peripheral surface of the stem portion 32 does not touch the inner peripheral surface of the valve attachment hole 25. Meanwhile, the multiple positioning claws 35 of the retaining member 29 engage with the respective through-holes 26 in the gasket 4 to thereby hold the stem portion 32 at the position concentric with the valve attachment hole 25. For these reasons, the stem portion 32 does not touch the inner peripheral surface of the valve attachment hole 25 with the certain distance kept between the overall periphery of the stem portion 32 and the inner peripheral surface of the valve attachment hole 25. Accordingly, the stem portion 32 can be prevented from damage due to its contact with a sharp inner peripheral edge of the valve attachment hole 25 in the thin gasket 4, and to maintain durability of the stem portion 32. Furthermore, since the through-holes 26 for allowing the passage of the positive pressures double as the holes with which the positioning claws 35 engage, it is unnecessary to provide dedicated positioning holes in the gasket 4. This contributes to simplifying the structure.

Moreover, the stem portion 32 includes: the first shaft portion 32*a* extending from the boss portion 31 of the umbrella portion 30, and fitted into the fitting hole 34 in the retaining member 29; and the second shaft portion 32*b* coaxially continuing to the first shaft portion 32*a* via the expanded portion 32*c*, and being smaller in diameter than the first shaft portion 32*a*. The expanded portion 32*c* is formed larger in diameter than the first shaft portion 32*a* to hold the retaining member 29 on the first shaft portion 32*a* by engaging with the rear surface of the retaining member 29. For these reasons, when the fitting hole 34 of the retaining member 29 is fitted to the first shaft portion 32*a*, the fitting hole 34 can easily pass through the expanded portion 32*c* with the diameter of the expanded portion 32*c* decreased by pulling the second shaft portion 32*b*. Accordingly, ease of installation of the unidirectional valve V can be enhanced.

The present invention is not limited to the foregoing embodiment. Various design changes can be made to the present invention within the scope not departing from the gist of the present invention. For example, instead of the oil dipper 24, an oil slinger to be rotationally driven by the crank shaft 7 may be used to generate the oil spray.

What is claimed is:

1. A general-purpose engine comprising: a crank case having a mounting flange in a bottom portion of the crank case; a cylinder block extending obliquely from one side of the crank case; a cylinder head connected to an end surface of the cylinder block via a gasket; a crank chamber in the crank case; oil spray generating means for generating oil spray for lubricating engine parts by scattering lubricant oil reserved in the crank chamber; upper and lower side portions of the cylinder block and the cylinder head are provided respectively with an upper oil passage and a lower oil passage which communicate the crank chamber and a valve operating chamber in the cylinder head with each other; and a unidirectional valve arranged on the gasket and comprising a valve body comprising an elastic umbrella portion, wherein the unidirectional valve is configured to allow a flow of a fluid from the crank chamber to the valve operating chamber and to block a reverse flow of the fluid is installed in the upper oil passage, and in a case where the lubricant oil reserved in the crank chamber flows into the valve operating chamber via the lower oil passage when the engine inclines such that the obliquely extending cylinder block further slants, positive pressures transmitted from the crank chamber to the valve operating chamber via the unidirectional valve push the oil, which once flows into the valve operating chamber, back to the crank chamber via the lower oil passage.

2. The general-purpose engine according to claim 1, wherein the gasket interposed between the cylinder block and the cylinder head divides the upper oil passage into an upstream passage on the crank chamber side and a downstream passage on the valve operating chamber side, the gasket comprises: a valve attachment hole, and a plurality of through-holes disposed surrounding the valve attachment hole, and communicating the upstream passage and the downstream passage with each other, and the unidirectional valve comprises: the valve body comprises: the elastic umbrella portion seated on an upper surface of the gasket facing the downstream passage, and covering a group of the through-holes, and a stem portion projecting from a boss portion of the elastic umbrella portion, and penetrating through the valve attachment hole, and a retaining member fitted and fixed to the stem portion, and thereby clamping the gasket in cooperation with the boss portion.

3. The general-purpose engine according to claim 2, wherein the stem portion is formed smaller in diameter than the valve attachment hole such that an outer peripheral surface of the stem portion is prevented from touching an inner peripheral surface of the valve attachment hole, and the retaining member includes a plurality of positioning claws respectively engaging with the plurality of through-holes to thereby hold the stem portion at a position concentric with the valve attachment hole.

4. The general-purpose engine according to claim 2, wherein the stem portion comprises:

a first shaft portion extending from the boss portion, and fitted into a fitting hole in the retaining member, and a second shaft portion coaxially continuing to the first shaft portion via an expanded portion, and being smaller in diameter than the first shaft portion, and the expanded portion is formed larger in diameter than the first shaft portion to hold the retaining member on the first shaft portion by engaging with a rear surface of the retaining member.

5. The general-purpose engine according to claim 3, wherein the stem portion comprises:

a first shaft portion extending from the boss portion, and fitted into a fitting hole in the retaining member, and a second shaft portion coaxially continuing to the first shaft portion via an expanded portion, and being smaller in diameter than the first shaft portion, and the expanded portion is formed larger in diameter than the first shaft portion to hold the retaining member on the first shaft portion by engaging with a rear surface of the retaining member.

* * * * *